US009683342B2

(12) United States Patent
Bishop

(10) Patent No.: US 9,683,342 B2
(45) Date of Patent: Jun. 20, 2017

(54) SINGLE NET CAPTURE MARINE BARRIER SYSTEM

(71) Applicant: HALO Maritime Defense Systems, Inc., Newton, NH (US)

(72) Inventor: Justin Bishop, West Caldwell, NJ (US)

(73) Assignee: Halo Maritime Defense Systems, Inc., Newton, NH (US)

( * ) Notice: Subject to any disclaimer, the term of this patent is extended or adjusted under 35 U.S.C. 154(b) by 103 days.

(21) Appl. No.: 14/554,252

(22) Filed: Nov. 26, 2014

(65) Prior Publication Data

US 2015/0159335 A1 Jun. 11, 2015

Related U.S. Application Data

(60) Provisional application No. 61/908,936, filed on Nov. 26, 2013.

(51) Int. Cl.

| | |
|---|---|
| ***E02B 3/26*** | (2006.01) |
| ***E02B 3/04*** | (2006.01) |
| ***E02B 3/06*** | (2006.01) |
| ***B63G 9/04*** | (2006.01) |
| ***E02B 7/20*** | (2006.01) |

(Continued)

(52) U.S. Cl.

CPC ..... *E02B 3/06* (2013.01); *B63G 9/04* (2013.01); *E02B 3/20* (2013.01); *E02B 7/20* (2013.01); *E02B 15/08* (2013.01); *F41H 11/05* (2013.01); *E02B 3/062* (2013.01)

(58) Field of Classification Search

CPC ... F41H 11/05; B63G 9/04; E02B 3/04; E02B 3/26; E02B 3/062; E02B 7/20; E02B 7/50; E02B 17/003

USPC ..... 405/21, 26, 27, 60, 211, 212; 114/241, 114/204 R, 204 A, 240 B, 240 E; 256/13; 403/173, 174

See application file for complete search history.

(56) References Cited

U.S. PATENT DOCUMENTS

| | | | |
|---|---|---|---|
| 1,158,555 | A | 11/1915 | Prescott |
| 1,278,970 | A | 9/1918 | Maxwell |

(Continued)

OTHER PUBLICATIONS

International Search Report and Written Opinion of the International Searching Authority mailing date Feb. 25, 2015 in PCT/US2014/067524.

(Continued)

*Primary Examiner* — Frederick L Lagman
*Assistant Examiner* — Stacy Warren
(74) *Attorney, Agent, or Firm* — Miles & Stockbridge P.C.; Michael A. Messina

(57) ABSTRACT

A marine barrier has a plurality of column modules, each having a vertical column, and an impact net attached to and extending between the column modules. Each of the columns has four buoyant horizontal legs extending from its lower portion. A distal end of each of the legs is attachable to a distal end of a corresponding leg of an adjacent column module to form a series of diamond-shaped supports between the columns to support the columns and the impact net. When the barrier is floating in a body of water and a moving vessel impacts the impact net, the impact net deflects to transfer a force of the impact to one or more of the column modules, which in turn engage the water to transfer the force of the impact to the water, to arrest the motion of the vessel.

11 Claims, 13 Drawing Sheets

(51) Int. Cl.

| | |
|---|---|
| ***E02B 15/08*** | (2006.01) |
| ***E02B 3/20*** | (2006.01) |
| ***F41H 11/05*** | (2006.01) |

(56) References Cited

U.S. PATENT DOCUMENTS

| | | | | |
|---|---|---|---|---|
| 1,299,243 | A | 4/1919 | Sheransky | |
| 2,041,662 | A | 5/1936 | Mapes | |
| 2,716,959 | A | 9/1955 | Betts | |
| 3,020,567 | A | 2/1962 | Colt | |
| 3,185,445 | A | 5/1965 | Broadway | |
| 5,179,907 | A * | 1/1993 | Galbraith | G09F 17/00 116/173 |
| 5,980,159 | A * | 11/1999 | Kazim | B63B 1/107 405/196 |
| 6,591,774 | B2 | 7/2003 | Metherell | |
| 6,681,709 | B1 * | 1/2004 | Nixon | B63G 9/04 114/240 C |
| 6,960,047 | B2 * | 11/2005 | Knezek | B63B 5/24 114/240 C |
| 7,140,599 | B1 * | 11/2006 | Spink | B63G 9/04 114/241 |
| 7,401,565 | B2 * | 7/2008 | Nixon | F41H 11/05 114/240 C |
| RE40,616 | E | 1/2009 | Nixon | |
| 2004/0018060 | A1 | 1/2004 | Knezek | |
| 2004/0115002 | A1 | 6/2004 | Meeks | |
| 2006/0216116 | A1 * | 9/2006 | Baker | F41H 11/05 405/63 |
| 2007/0102689 | A1 | 5/2007 | Alberson | |
| 2013/0108368 | A1 | 5/2013 | Bishop | |

OTHER PUBLICATIONS

International Search Report and Written Opinion of the International Searching Authority mailing date Feb. 24, 2015 in PCT/US2014/067558.

* cited by examiner

SINGLE NET CAPTURE MARINE BARRIER SYSTEM

RELATED APPLICATIONS

The present application claims priority to U.S. Provisional Application No. 61/908,936, entitled "Improvements to Marine Barrier and Gate Systems," filed Nov. 26, 2013, which is incorporated herein by reference in its entirety.

TECHNICAL FIELD

The present subject matter relates to marine barriers and movable gates. The present disclosure has particular applicability to marine barriers for arresting the motion of a vessel impacting the barrier.

BACKGROUND

Structures for use on both land and/or water as security barrier systems have been previously developed. Such structures generally intend to stop intruding objects, and range from thick, solid walls blocking the object's progress to secured areas for disabling the propelling mechanism of the object. These structures commonly exhibit noticeable shortcomings. First, these structures are often cumbersome and time-consuming to install and erect as and where desired. Second, they are difficult, or even impossible, to maintain and/or repair after they have sustained the impact of an intruding object. Third, they are often not adaptable to different needs and conditions.

One solution providing an improved marine barrier is shown in FIG. 1 and disclosed in U.S. patent application Ser. No. 13/586,270, filed Aug. 15, 2012, and published as US 2013/0119334, which is hereby incorporated by reference in its entirety. The marine barrier 400 of FIG. 1 includes two continuous pleated rows 401, 402 of first and second respective pluralities of buoyant panels 110, to form a diamond-shaped barrier. A plurality of outboard hinges 120 and a plurality of inboard hinges 420 elastically connect opposing sides of adjacent panels 110 with the included angle A therebetween to form two continuous pleated rows 401, 402, such that the hinges 120, 420 are arranged in first, second, and third substantially parallel rows.

A first plurality of impact cables 430 are attached to opposing ends of the first pleated row of panels 401 and pass through each of the hinges 120 in the first row of hinges. A second plurality of impact cables 430 are attached to opposing ends of the second pleated row of panels 402 and pass through each of the hinges 120 in the third row of hinges. In this example, there are five impact cables 430 associated with each of the pleated rows 401, 402, and they are substantially parallel to each other. Impact cables 430 comprise, for example, steel wire rope. Impact cables 430 can also be nets with vertical and horizontal wires rather than only horizontal wires as shown.

When the barrier 400 is floating in a body of water 440 and a moving vessel (represented by arrow 450) impacts one or more of the first plurality of impact cables 430 attached to the first pleated row 401 of panels 110, the impact cables 430 deflect to transfer a force of the impact to one or more of the first plurality of panels 110 of the first pleated row 401, which in turn engage the water 440, and to one or more of the second plurality of panels of the second pleated row 402, which in turn engage the water 440, to transfer the force of the impact to the water 440 and arrest the motion of the vessel.

Likewise, if a vessel impacts one or more of the second plurality of impact cables 430 attached to the second pleated row 402, the load path of the impact force will be similar, but in an opposite direction. Thus, during an impact the panels 110 are drawn in around the point of impact and engage the water to dissipate the impact force.

The marine barrier of FIG. 1 is a vast improvement over previous barriers, but is designed to be a permanent structure, and is designed to have a very high level of effectiveness. Consequently, it may be unnecessarily large, heavy, and/or costly for temporary applications, for deployment in remote areas, or for lower-performance applications that do not require its effectiveness or its built-in redundancies.

There exists a need for an effective marine barrier that is low cost, lightweight, and easily portable.

SUMMARY

The present disclosure provides a marine security barrier system that addresses the aforementioned needs.

Embodiments include a marine barrier comprising a plurality of column modules, each having a substantially vertical column, the columns being spaced apart from each other and arranged in a linear fashion; and an impact net attached to each of the columns and extending between the plurality of column modules. Each of the column modules comprises four substantially horizontal legs extending from a lower portion of the column, each of the legs including a buoyant portion. The legs and their buoyant portions are arranged such that a distal end of each of the legs is attachable to a distal end of a corresponding leg of an adjacent column module to form a series of diamond-shaped supports between the columns to support the columns and the impact net when the barrier is floating in a body of water. When the barrier is floating in the body of water and a moving vessel impacts the impact net, the impact net deflects to transfer a force of the impact to one or more of the column modules, which in turn engage the water to transfer the force of the impact to the water, to arrest the motion of the vessel.

Embodiments can also include the barrier wherein each column module includes four struts, each strut extending from one of the legs to a central portion of the column to support the leg in its position relative to the column. Each column module comprises a first plurality of hinges, each hinge for elastically connecting one of the legs to the column, and a second plurality of hinges, each hinge for elastically connecting one of the struts to the column. The barrier also comprises a third plurality of hinges, each hinge for elastically connecting the distal end of one of the legs of one of the column modules to the distal end of the corresponding leg of an adjacent column module with an included angle therebetween to form the series of diamond-shaped supports between the columns. The legs and struts are movable from an expanded position where adjacent ones of the legs are disposed with the included angle therebetween, to a retracted position where the legs are substantially parallel to each other.

Embodiments can further comprise the barrier wherein each column module includes four struts, each strut extending from one of the legs to a central portion of the column to support the leg in its position relative to the column. Each of the legs of each column module is pivotably attached to the lower portion of the column, and each strut is pivotably attached to one of the legs, such that the legs and struts are movable between an unfolded position where the legs are substantially perpendicular to the column, and a folded position where the legs are substantially parallel to the column.

Objects and advantages of embodiments of the disclosed subject matter will become apparent from the following description when considered in conjunction with the accompanying drawings.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

Disclosed herein are marine barrier and gate systems. In the disclosed barrier and gate systems, a single impact net is strung between central columns in what is referred to as a "single net capture mechanism," in contrast to the two-net capture mechanism shown in FIG. 1, which has an impact net (or set of impact cables 430) attached to each of the front and rear faces of the barrier. The disclosed single net capture system is a simpler, lower-cost alternative for users who do not require the highest level of security.

Figure 1:
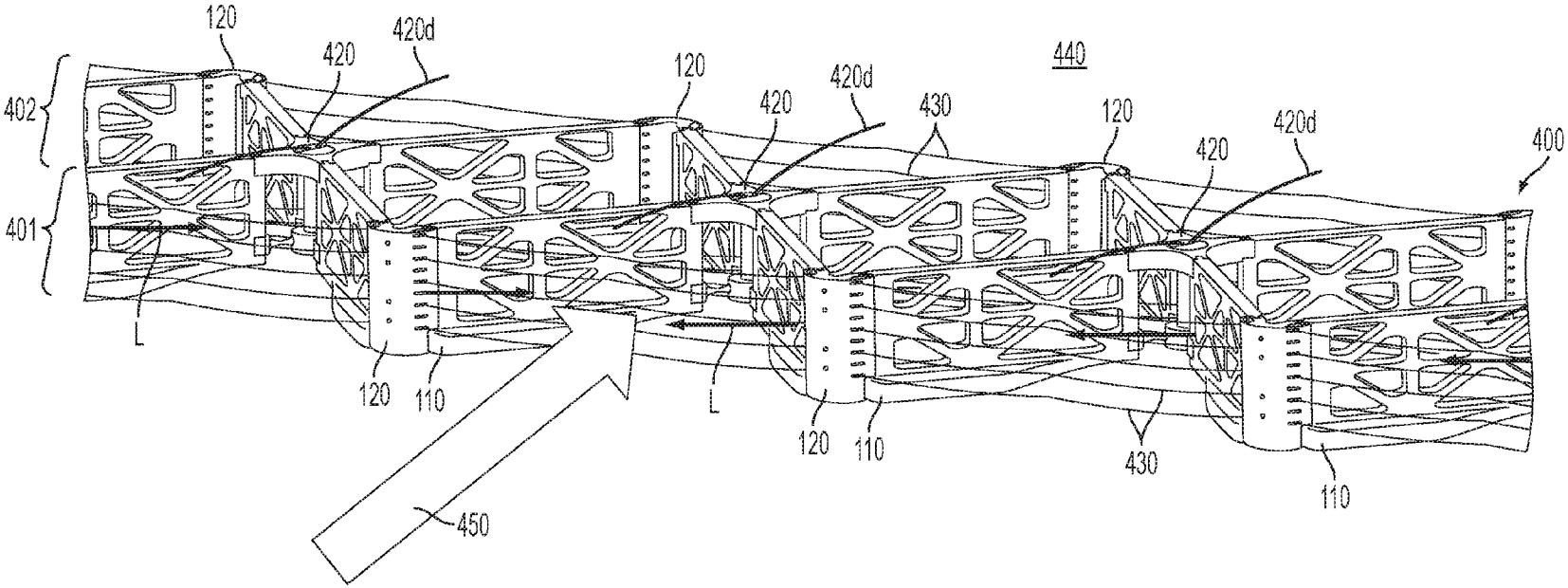
FIG. 1 PRIOR ART
FIG. 1 is a perspective view of a marine barrier.
Figure 2A:
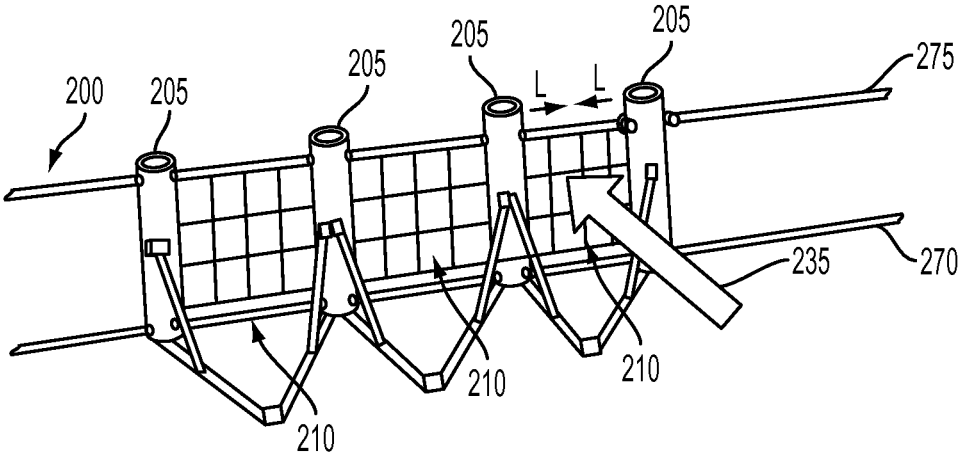
FIG. 2*a* is a partial perspective view diagrammatically illustrating an exemplary marine barrier according to various embodiments.
Figure 2B:
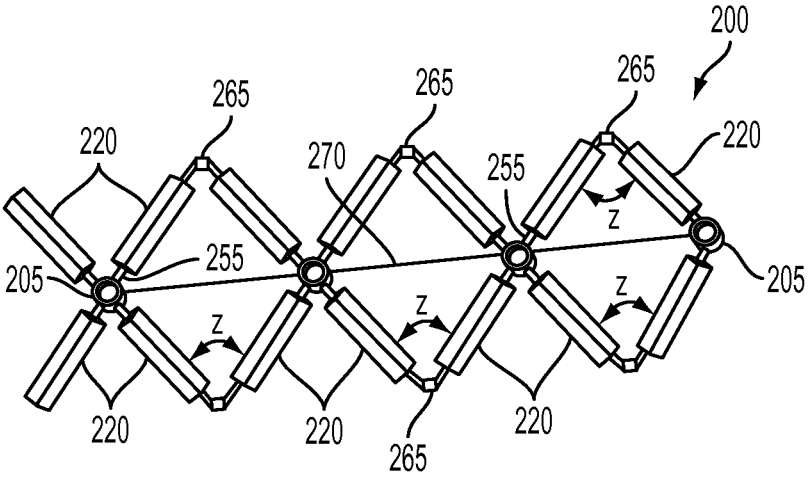
FIG. 2*b* is a bottom view diagrammatically illustrating the marine barrier of FIG. 2*a*.

As shown in FIGS. 2*a-b*, one embodiment of the disclosed single net capture system 200 includes a series of central columns 205 arranged in a line, which support the same type of impact net 210 as in the barrier of FIG. 1 strung between them. As best seen in FIG. 2*b* and FIG. 3*b*, the central substantially vertical columns 205 are joined to each other and supported in the water by frames 215, each having a lower horizontal leg 220 attached to a lower portion of the column 205 and a diagonal strut 225 also attached to the column 205. Each leg includes a float 230. The legs 220 and floats 230 are arranged such that a distal end of each of the legs 220 is attachable to a distal end of a corresponding leg 220 of an adjacent column 205 to form a series of diamond-shaped supports between the columns 205, to support the columns 205 and the impact net 210 when the barrier 200 is floating in a body of water. The combination of a column 205 and four frames 215 is referred to hereinafter as a "column module" 250.

When the barrier 200 is floating in the body of water and a moving vessel 235 impacts the impact net 210, the impact net 210 deflects to transfer a force of the impact to one or more of the column modules (see arrows L), which in turn engage the water to transfer the force of the impact to the water, to arrest the motion of the vessel 235.

Figure 3A:
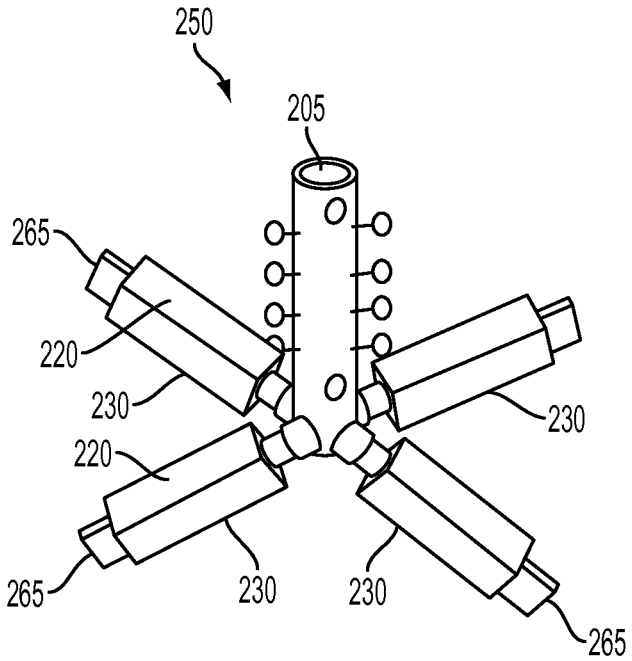
FIGS. 3*a-b* are perspective views of an exemplary column module of a marine barrier in accordance with the disclosure.
Figure 3B:
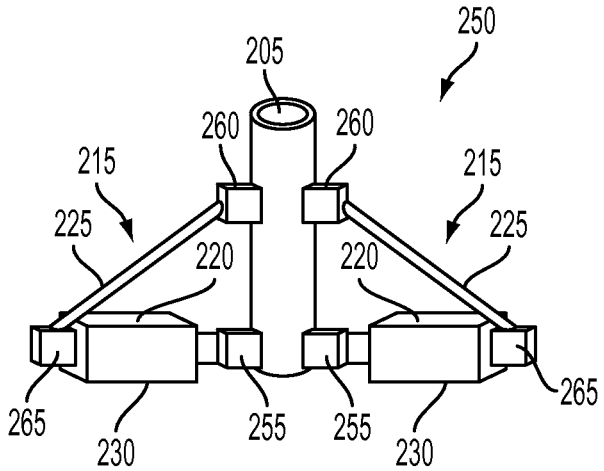

In the embodiment shown in FIGS. 3*a*-3*b*, the barrier comprises a plurality of the column modules 250, each including a substantially vertical column 205, four substantially horizontal legs 220 extending from a lower portion of the column 205, and four struts 225 extending from the legs 220 to a central portion of the column 205 to support the legs 220 in their position relative to the column 205. A distal end of each of the legs 220 is attachable to a distal end of a corresponding leg 220 of an adjacent column 205 to form diamond-shaped supports between the columns. The columns 205, legs 220, and struts 225 advantageously comprise a well-known lightweight material such as aluminum or composite plastic resin.

The legs 220 and struts 225 are joined to the columns 205 and to each other via elastic hinges, such as rubber hinges. More particularly, each column module 250 comprises a first plurality of hinges 255, each hinge 255 for elastically connecting one of the legs 220 to the column 205, and a second plurality of hinges 260, each hinge 260 for elastically connecting one of the struts 225 to the column 205. A third plurality of hinges 265 elastically connect the distal end of one of the legs 220 of one of the column modules 250 to the distal end of the corresponding leg 220 of an adjacent column module 250 with an included angle Z therebetween to form the series of diamond-shaped supports between the columns 205.

Figure 4A:
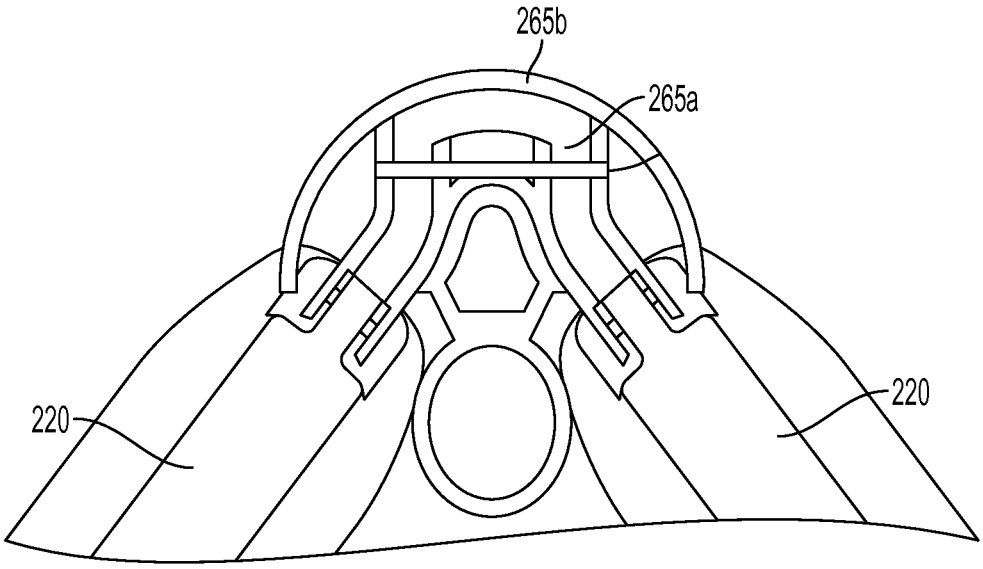
FIGS. 4*a-b* are views of a hinge used in a marine barrier in accordance with the disclosure.
Figure 4B:
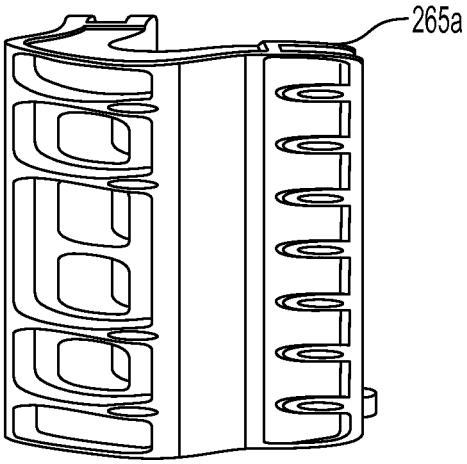

In certain embodiments, the hinges 255, 260, 265 comprise EPDM rubber having a Durometer value of about 60 to about 70. As shown in FIGS. 4*a-b*, the third plurality of hinges 265 are outboard hinges, each comprising a core 265*a* of an elastic material (e.g., such as the EPDM rubber discussed immediately above) for attaching to the distal ends of two of the legs 220 with the included angle Z therebetween to form the diamond shaped supports; and an outer shell 265*b*, such as high density polyethylene, for attaching to and covering a portion of the core 265*a*, and for engaging the two of the legs 220, such that when the barrier 200 is floating in the body of water and a vessel impacts the outer shell 265*b*, the outer shell 265*b* guides the vessel into engagement with the impact net 210.

Figure 5:
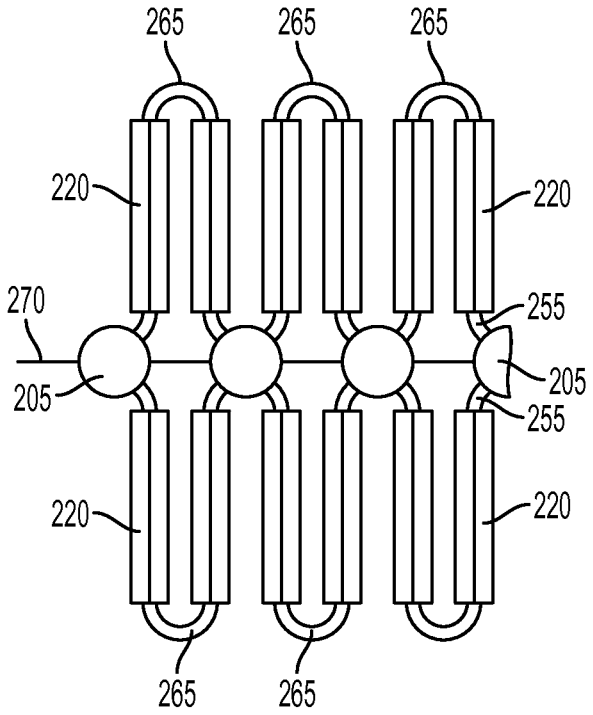
FIG. 5 is a bottom view diagrammatically illustrating the marine barrier of FIGS. 2*a-b* when the barrier is in a retracted position.

Particular embodiments of this barrier are equipped with one or more cables and are usable as a gate. In such embodiments, such as shown in FIGS. 2*b* and 5, the legs 220 and struts 225 are movable from an expanded position (FIG. 2*b*) where adjacent ones of the legs 220 are disposed with the included angle Z therebetween, to a retracted position where the legs 220 are substantially parallel to each other (FIG. 5). A haul cable 270 is attached to an end one of the column modules 250 and passes through the other column modules 250, for moving the legs 220 and struts 225 from the expanded position to the retracted position; for example, using a winch (not shown). In certain embodiments, a catenary cable 275 is also provided to absorb environmental loads.

In further embodiments of the disclosed single net capture system, shown in FIGS. 6*a*-10, a barrier similar to that of FIGS. 2*a*-5 is provided, but the barrier is divided into folding column modules that fit into a standard shipping container, such as a 40 foot High Cube (or "Hi Q") container. The column modules ship in a folded condition, and are easily unfolded and attached to each other on-site. Such embodiments provide a low-cost, lightweight barrier that can be rapidly deployed and assembled in remote locations. These barriers are easy to produce, and assemble on-site by a small crew of workers; e.g. two workers.

Figure 6A:
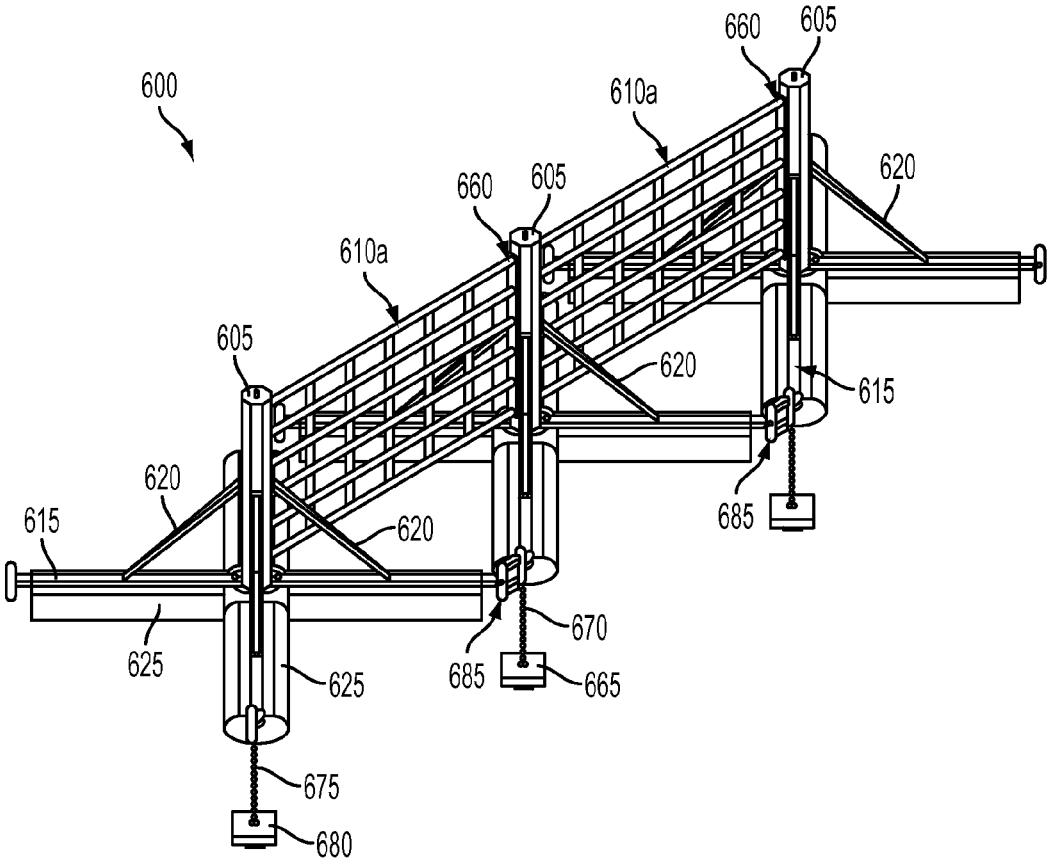
FIG. 6*a* is a front view diagrammatically illustrating an exemplary marine barrier according to various embodiments.
Figure 6B:
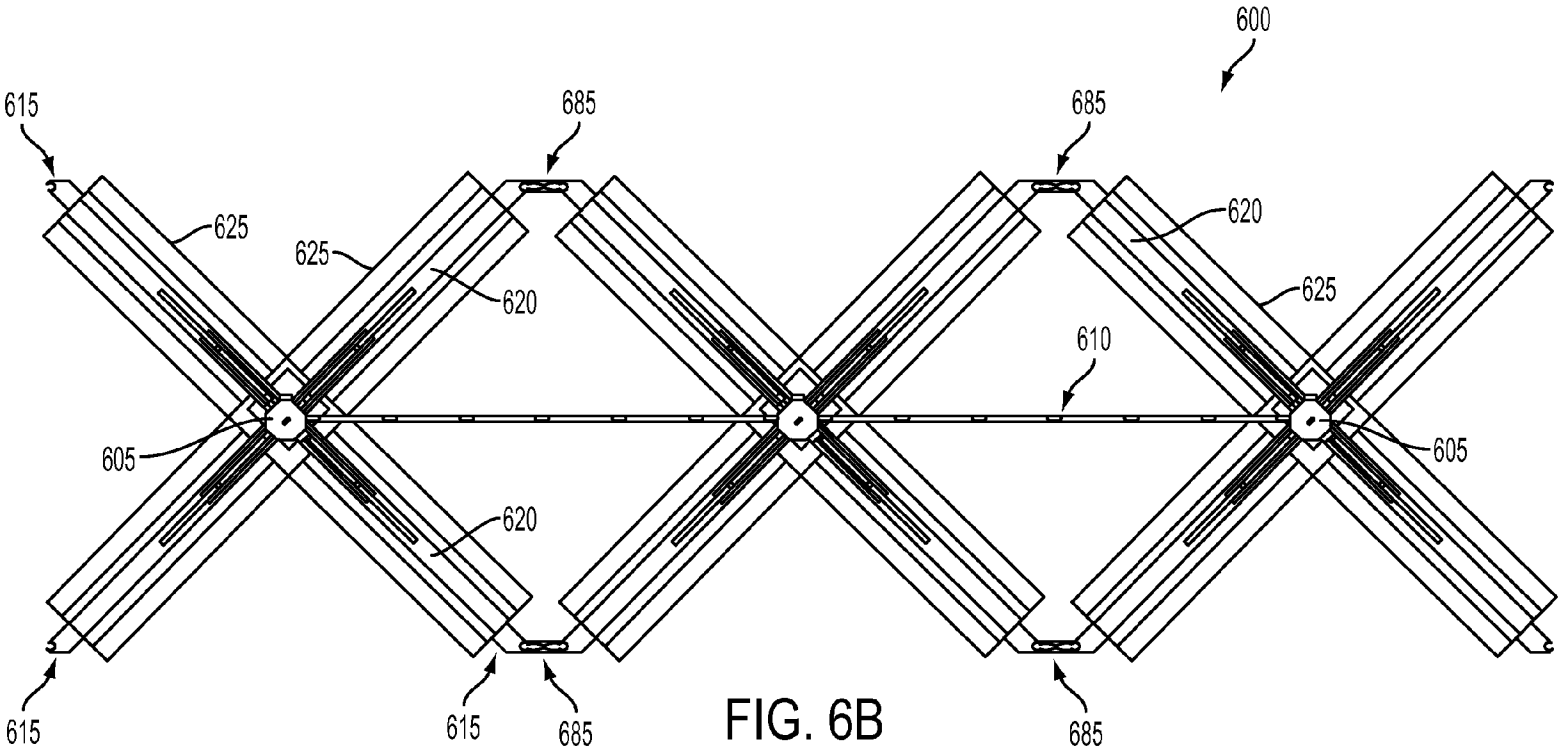
FIG. 6*b* is a top view of the marine barrier of FIG. 6*a*.

An assembled barrier 600 according to this embodiment of the disclosure is shown in FIGS. 6*a*-*b*. The barrier 600 includes a plurality of columns 605 which support the same type of impact net 610 as in FIGS. 1-5 strung between them. The central columns 605 are each supported in the water by a plurality of folding legs 615; for example, four legs 615, each leg movably attached to a lower portion of the column 605, and a diagonal strut 620 also movably attached to the column 605 and the leg 615. Each leg includes a float 625. The floats 625 and legs 615 are arranged in a diamond pattern, and act as outriggers to support the columns 605 and the net 610. In one embodiment, the columns 205 are spaced about 8 feet apart from one another, and are 8 feet high.

Figure 7A:
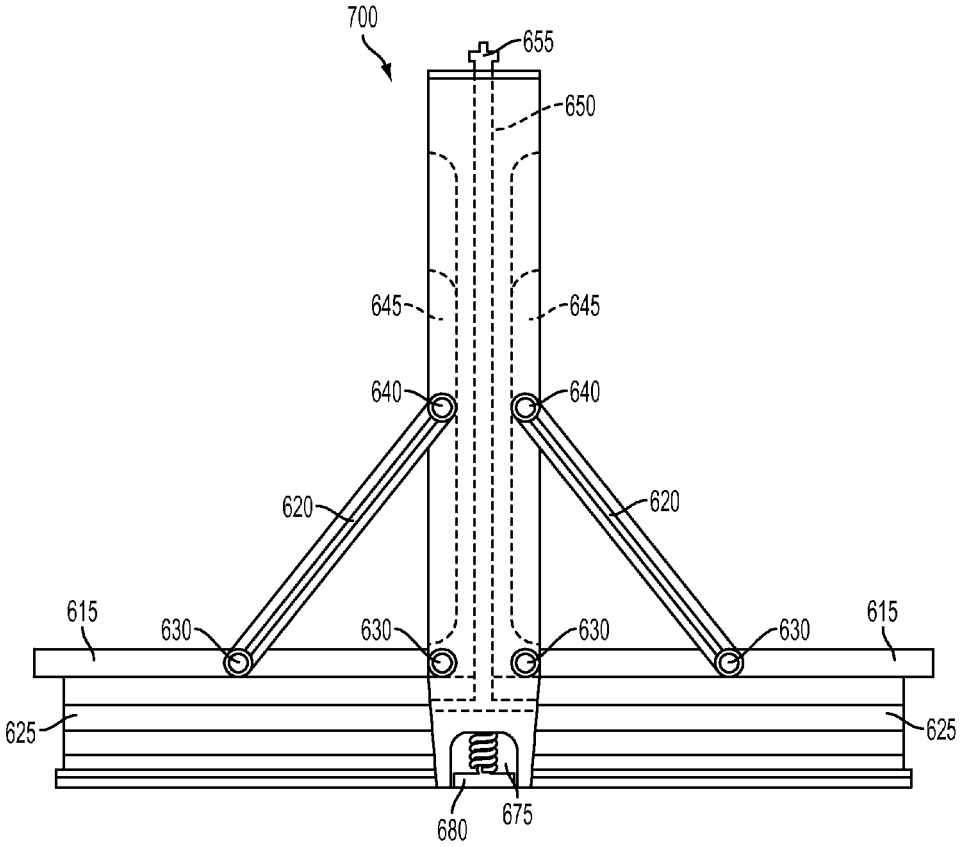
FIG. 7*a* is a side view of a column module of the barrier of FIG. 6*a* with its legs in an unfolded position.

Referring now to FIGS. 7*a*-9*b*, an exemplary column module 700 of barrier 600 comprises one of the columns 605, such as a lightweight extruded aluminum or composite plastic column, and a plurality of the elongate legs 615 comprising similar materials pivotably attached to a lower portion of the column, as by a pivot pin 630. The legs 615 are movable between an unfolded position shown in FIGS. 7*a*-*b* where the legs 615 are substantially perpendicular to the column 605, an intermediate position shown in FIG. 8, and a folded position shown in FIGS. 9*a*-*b* where the legs 615 are substantially parallel to the column 605. In certain embodiments, the legs 615 are flush or substantially flush with an outside surface of the column 605 when the legs 615 are in the folded position, to facilitate packing and shipping. As shown in FIG. 7*b*, the column 605 has compartments 635 within it to accept each respective leg 615 when the leg 615 is in the folded position. As best seen in FIG. 7*a*, each leg has one end of a strut 620 pivotably attached to it, as by a pivot pin 630. The opposing end of the strut 620 is slidably attached to the column 605, as by a slider 640 that rides in a track 645 in a compartment of the column.

Figure 7B:
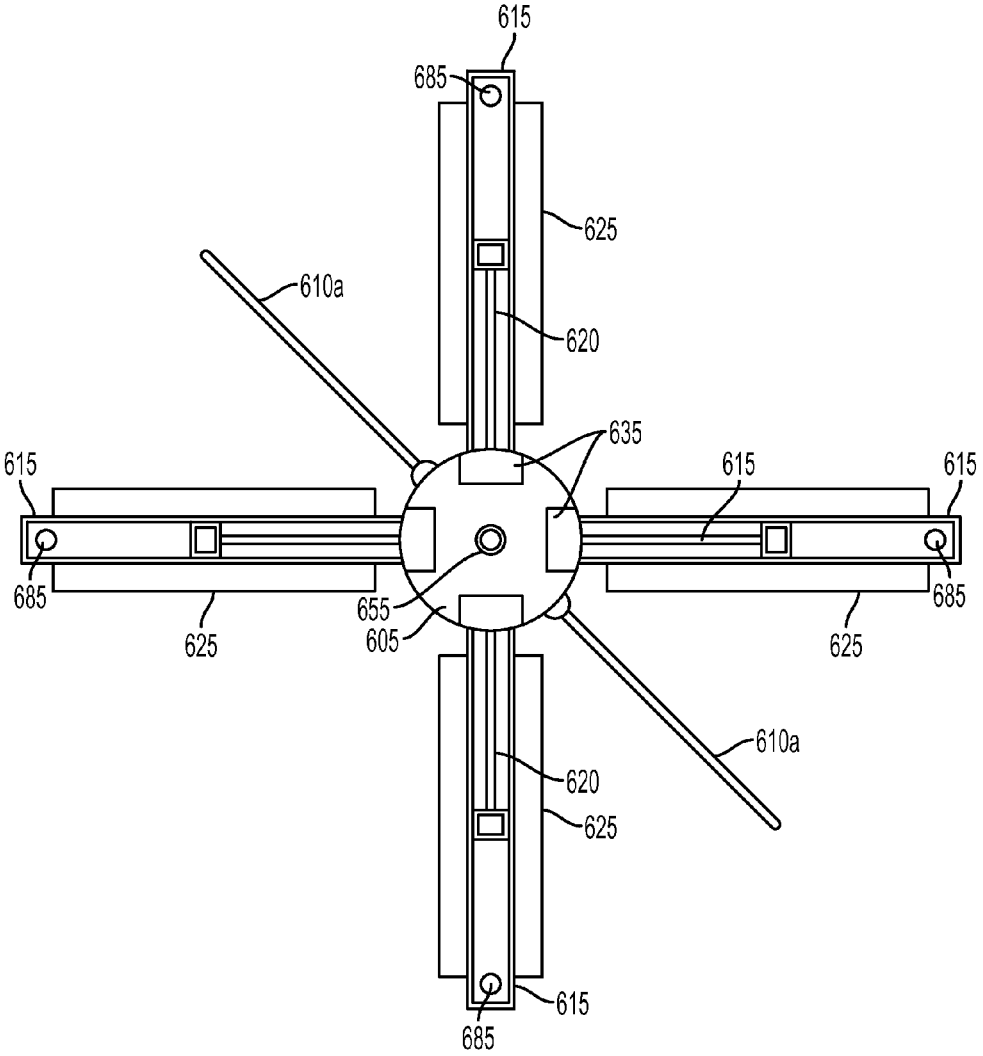
FIG. 7*b* is a top view of a column module of the barrier of FIG. 6*a* with its legs in an unfolded position.
Figure 9B:
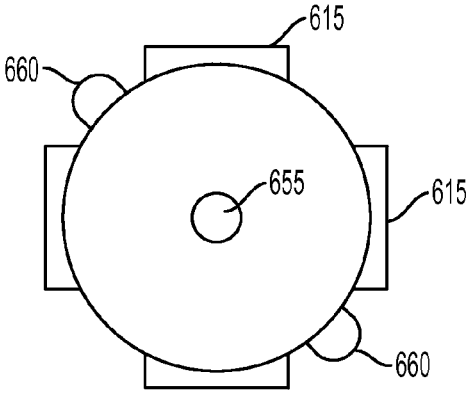
FIG. 9*b* is a top view of a column module of the barrier of FIG. 6*a* with its legs in a folded position.
Figure 9A:
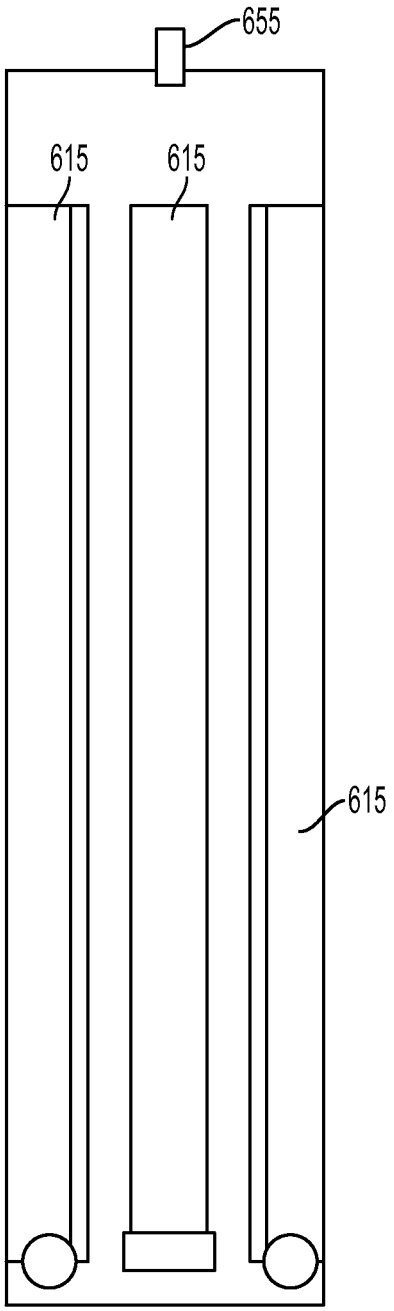
FIG. 9*a* is a side view of a column module of the barrier of FIG. 6*a* with its legs in a folded position.

When the struts 620 are moved from the folded position shown in FIGS. 9*a*-*b* to the unfolded position shown in FIGS. 7*a*-*b*, the struts 620 can then be locked in place as by a pin or other fastener (not shown) passing through holes in the column 605, or through holes in the column 605 and the strut slider 640. The extended legs 615 of adjacent column modules 700 can then be joined together by locking pins 685 or clips to form the diamond patterns between columns 605.

Figure 7C:
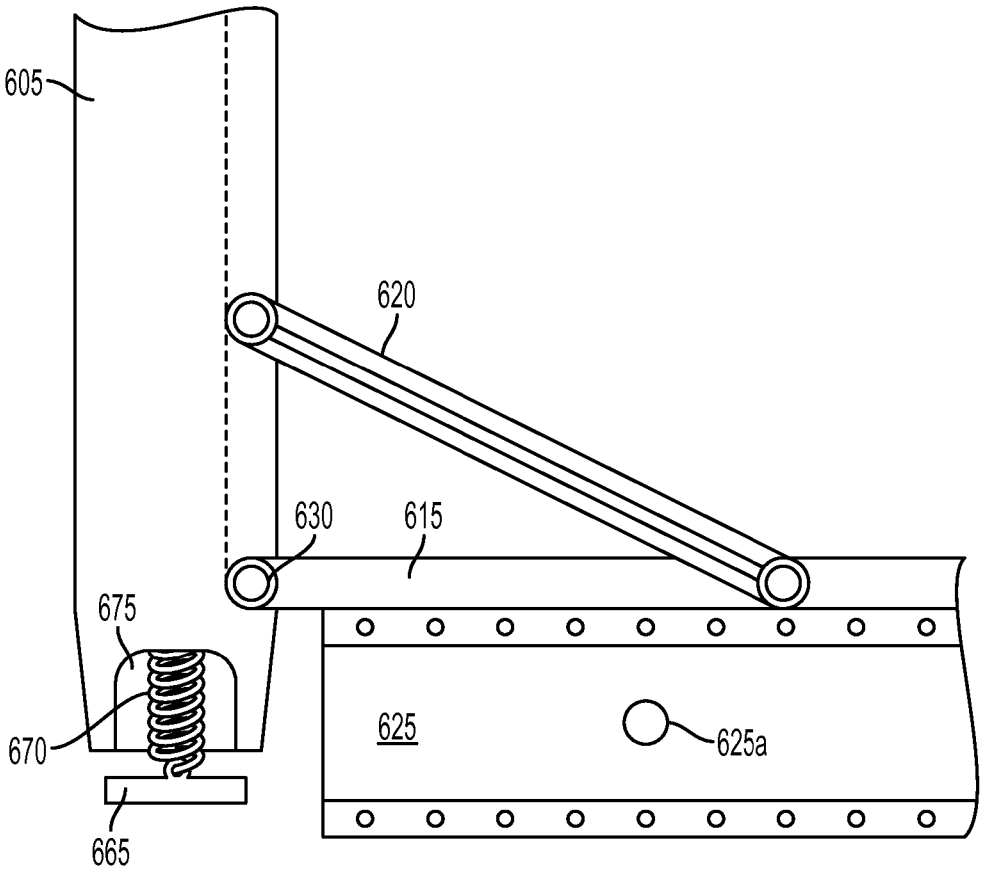
FIG. 7*c* is a partial side view of an alternative column module for the barrier of FIG. 6*a*.
Figure 8:
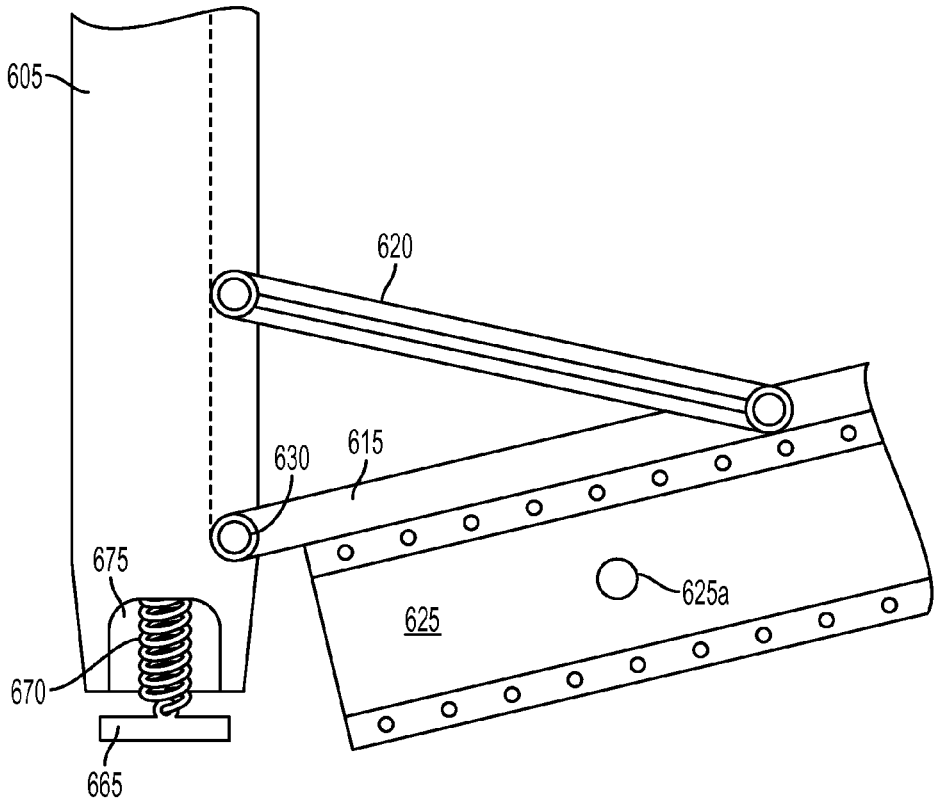
FIG. 8 is a side view of a column module of the barrier of FIG. 6*a* with its legs in a partially folded position.

In certain embodiments, shown in FIG. 7*c*, the floats 625 are conventional inflatable oil containment-type bladders bolted to each leg 615, each bladder 625 having an air fill port 625*a* and being individually inflatable. In other embodiments, shown in FIGS. 1*a*-*b* and 9*a*-*b*, a manifold 650 which is inside the column 605 and/or attached to the column 605 is used to direct air (from a compressed air supply) through a manifold air fill port 655 to all the bladders 625 of the column subassembly 700. In this way, the bladders 625 can be filled at the same time.

The impact net 610 comprises a plurality of separate foldable net segments 610*a*, each net segment 610*a* extendable between a pair of adjacent columns 605 when the legs 615 are in the unfolded position and the distal ends of the legs 615 are attached to each other to form the diamond-shaped supports. Each column 605 includes a plurality of net attachment points 660 on opposing sides of the column, such as conventional eye bolts or U-bolts, between the compartments 635 for attaching a net segment 610*a* via clips. The net segments 610*a* are attached between adjacent ones of the columns 605, and can comprise conventional materials such as a fiber rope or steel wire rope. Fiber nets are more easily folded, and in certain embodiments the net segments 610*a* are folded and fixedly attached at one end to a column 605 prior to shipping, similarly to a rope ladder. They can thus be unfurled at a jobsite, and only one end of each net segment 610*a* needs to be attached to an adjacent column 605. Assembly of the barrier in the field is thereby facilitated.

In further embodiments, one or more of the columns 605 in a barrier include a weight attached to the column by a rope, which is dropped into the water to anchor the barrier. As shown in FIG. 7*c*, an anchor weight 665 is attached to a coiled rope 670, wherein the anchor 665 and the rope 670 are disposed in a recess 675 within the column 605. The anchor 665 and rope 670 are held in place in the column via a release mechanism such as a pin (not shown), which is pulled out to drop the anchor weight 665 when the column 605 is in the water. This anchor weight/rope arrangement is typically not provided in every column 605 of a barrier, but on as many columns as needed based on the environment in which the barrier is deployed.

In certain embodiments shown in FIG. 7*a*, the columns 605 of a barrier that do not have the anchor weight 665 are equipped instead with a simple weight 680 stored in the recess 675 of the column and having the same or similar release mechanism. After release, the weight hangs below the column and acts as a counterbalance to pitching motion of the barrier on the surface of the water (or other environmental loads acting on the barrier), adding to the stability of the barrier. In certain embodiments, weight 680 is shaped to increase the structure's drag; e.g., by providing a plate-shaped weight 680, to counteract environmental loads and also to increase the barrier's effectiveness during an impact. In further embodiments, weight 680 comprises several weights hanging from a column, and/or rope 670 is daisy chained with one or more ropes from other columns, such that the ropes together support a larger plate or weight between columns.

In an exemplary embodiment, the length of a site to be protected by the barrier 600 is determined (e.g., 500 feet) and the number of column modules 700 having an anchor weight 665 or a counterbalancing weight 680 is calculated (e.g., 20 anchoring modules and 50 counterweight modules). Since all the modules 700 stack the same way in a container and look similar to each other, they are each color coded (e.g., yellow for anchor, orange for counterweight). Depending on the depth of water, mooring lines of appropriate lengths are preloaded into certain columns 605 or attached to the columns to be deployed when the barrier 600 is in the water. Alternatively, an anchor line having a ring on one end is stored inside a column 605 and dropped from the column into the water, then moorings are attached to the ring hung below the column.

Figure 10:
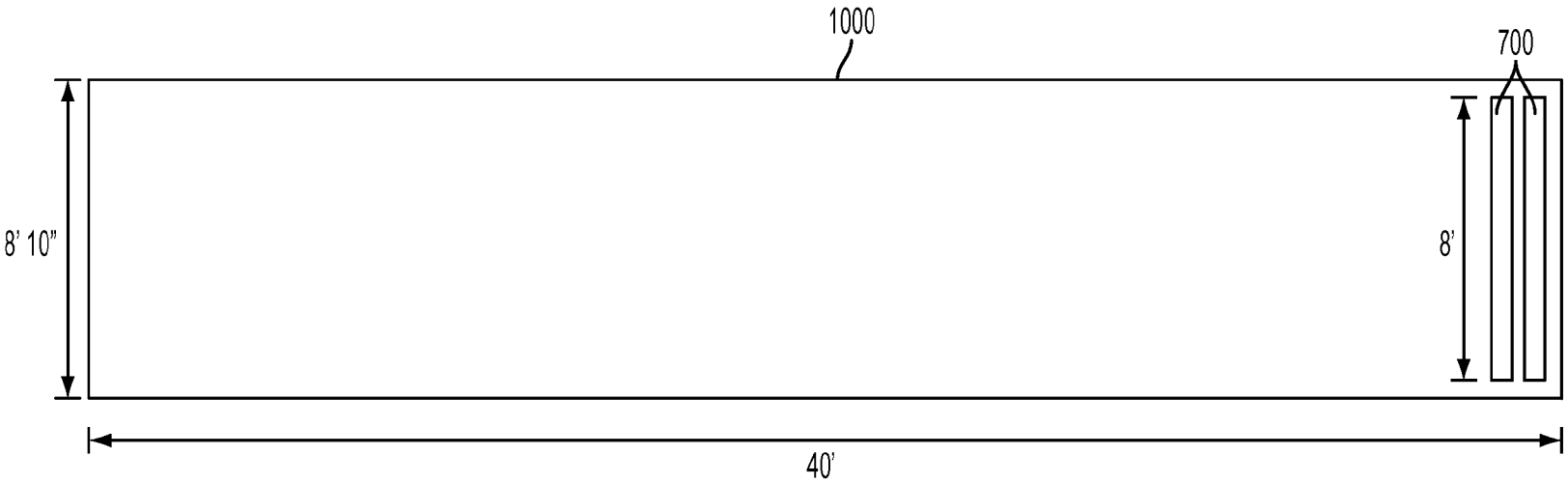
FIG. 10 is a top cutaway view of a standard shipping container loaded with folded column modules of the barrier of FIG. 6*a*.

The above-described embodiments of the disclosed barrier 600 having foldable modular elements can be fully containerized; that is, they fit into a standard shipping container, such as a 40-foot long Hi Q container. As shown in FIG. 10, the modular column subassemblies 700 are about 8 feet long and 1 foot in diameter when folded. Therefore, they can be easily stacked or nested inside a standard shipping container 1000 without a waste of space inside the container 1000. If the net segments 610*a* are not pre-attached to the columns 605 and furled, the net segments 610*a* can be placed inside the container 1000 with the column modules 700, such as along a side of the container 1000. Since the column modules 700 are made of light-weight materials, as discussed herein above, they can be loaded and unloaded easily by a pair of workers.

An exemplary assembly sequence of a containerized barrier, further illustrating the ease of assembly of the disclosed barrier 600 in the field, will now be described. The following steps are intended to be performed by a small number of workers, such as two workers, and can be performed manually except where indicated. First, the column modules 700 are removed from the container 1000 and stood upright. The legs 615 are then extended and manually locked in place (e.g., with pins in the column 605), thereby simultaneously locking the struts 620 in position as well. The extended legs 615 of adjacent column modules 700 are joined together by locking pins 685 or clips to form the diamonds, and the net segments 610*a* are attached. If net segments 610*a* are pre-assembled to the columns 605 and folded, they are simply unfurled and their free ends clipped to the appropriate column 605. Finally, the flotation bladders 625 attached to the legs are inflated, either individually via the ports 625*a* on each bladder, or simultaneously through the air fill port 655 and manifold 650 on or in each of the columns 605.

It is, therefore, apparent that there is provided in accordance with the present invention, a single net capture marine barrier system. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

What is claimed is:

1. A marine barrier comprising:

a plurality of column modules, each having a substantially vertical column, the columns being spaced apart from each other and arranged in a linear fashion; and an impact net attached to each of the columns and extending between the plurality of column modules;

wherein each of the column modules comprises four substantially horizontal legs extending from a lower portion of the column, each of the legs including a buoyant portion;

wherein the legs and their buoyant portions are arranged such that a distal end of each of the legs is attachable to a distal end of a corresponding leg of an adjacent column module to form a series of diamond-shaped supports between the columns to support the columns and the impact net when the barrier is floating in a body of water;

wherein each column module comprises a first plurality of hinges, each hinge for elastically connecting one of the legs to the column;

wherein the barrier comprises a second plurality of hinges, each hinge for elastically connecting the distal end of one of the legs of one of the column modules to the distal end of the corresponding leg of an adjacent column module to form an included angle therebetween, to form the series of diamond-shaped supports between the columns; and wherein when the barrier is floating in the body of water and a moving vessel impacts the impact net, the impact net deflects to transfer a force of the impact to one or more of the column modules, which in turn engage the water to transfer the force of the impact to the water, to arrest the motion of the vessel.

2. The barrier of claim 1, wherein each column module includes four struts, each strut extending from one of the legs to a central portion of the column to support the leg in its position relative to the column.

3. The barrier of claim 2, wherein each column module comprises a third plurality of hinges, each hinge for elastically connecting one of the struts to the column.

4. The barrier of claim 3, wherein the first, second, and third plurality of hinges comprise rubber.

5. The barrier of claim 4, wherein the rubber comprises EPDM rubber having a Durometer value of about 60 to about 70.

6. The barrier of claim 3, wherein the legs and struts are movable from an expanded position where adjacent ones of the legs are disposed with the included angle formed therebetween, to a retracted position where the legs are substantially parallel to each other.

7. The barrier of claim 6, further including a cable attached to an end of one of the column modules and passing through the other column modules, for moving the legs and struts from the expanded position to the retracted position.

8. The barrier of claim 1, wherein each of the second plurality of hinges is an outboard hinge comprising:

a core of an elastic material for attaching to the distal ends of two of the legs to form the included angle therebetween, to form the diamond shaped supports; and an outer shell for attaching to and covering a portion of the core, and for engaging the two of the legs, such that when the barrier is floating in the body of water and a vessel impacts the outer shell of one of the outboard hinges, the outer shell guides the vessel into engagement with the impact net.

9. The barrier of claim 8, wherein the core comprises EPDM rubber having a Durometer value of about 60 to about 70, and the outer shell comprises high density polyethylene.

10. The barrier of claim 1, wherein the columns comprise aluminum or a plastic resin.

11. The barrier of claim 1, wherein the impact net comprises steel wire rope or fiber rope.

* * * * *